US009970714B2

(12) United States Patent
Zhou

(10) Patent No.: US 9,970,714 B2
(45) Date of Patent: May 15, 2018

(54) HEAT PIPE HEAT FLUX RECTIFIER

(71) Applicant: Toyota Motor Engineering & Manufacturing North America, Inc., Erlanger, KY (US)

(72) Inventor: Feng Zhou, South Lyon, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 22 days.

(21) Appl. No.: 15/151,891

(22) Filed: May 11, 2016

(65) Prior Publication Data

US 2017/0328646 A1 Nov. 16, 2017

(51) Int. Cl.

| | |
|---|---|
| ***F28D 15/00*** | (2006.01) |
| ***F28D 15/02*** | (2006.01) |
| ***F28D 15/04*** | (2006.01) |
| ***F28F 21/04*** | (2006.01) |
| ***F28F 21/06*** | (2006.01) |
| ***F28F 21/02*** | (2006.01) |
| ***F28F 21/08*** | (2006.01) |

(52) U.S. Cl.

CPC ..... *F28D 15/0266* (2013.01); *F28D 15/0233* (2013.01); *F28D 15/0258* (2013.01); *F28D 15/0275* (2013.01); *F28D 15/046* (2013.01); *F28F 21/02* (2013.01); *F28F 21/04* (2013.01); *F28F 21/06* (2013.01); *F28F 21/084* (2013.01); *F28F 21/085* (2013.01)

(58) Field of Classification Search

CPC ..... F28D 15/0266; F28D 15/0233; F28D 15/0258; F28D 15/0275; F28D 15/046; F28D 15/06; F28F 21/02; F28F 21/04; F28F 21/06; F28F 21/084; F28F 21/085; F24J 2/32

USPC ..... 165/104.26

See application file for complete search history.

(56) References Cited

U.S. PATENT DOCUMENTS 3,605,878 A * 9/1971 Coleman ..... F28D 15/06 165/104.26
4,382,466 A * 5/1983 Shiraishi ..... F24J 2/32 165/104.11

(Continued)

FOREIGN PATENT DOCUMENTS

JP 2001153577 6/2001
JP 5523186 6/2014

OTHER PUBLICATIONS

Advanced Cooling Technologies, Inc.; "Diode Heat Pipes"; URL: https://www.1-act.com/diode-heat-pipes/; 2016.

*Primary Examiner* — Davis Hwu
(74) *Attorney, Agent, or Firm* — Dinsmore & Shohl LLP

(57) ABSTRACT

Embodiments for a heat pipe heat flux rectifier are provided. One embodiment includes a first curved diode heat pipe that includes an adiabatic section that includes a curved portion, an evaporator section that is coupled to the adiabatic section, and a condenser section that is coupled to the adiabatic section. In some embodiments, the first curved diode heat pipe includes a non-condensable gas reservoir that is coupled to the condenser section for storing non-condensable gas, where the first curved diode heat pipe stores a fluid and a wicking material. In some embodiments, the first curved diode heat pipe operates as a thermal conductor when heat is applied to the evaporator section and as a thermal insulator when heat is applied to the condenser section.

20 Claims, 5 Drawing Sheets

(56) References Cited

U.S. PATENT DOCUMENTS

| | | | | |
|---|---|---|---|---|
| 5,004,354 | A | 4/1991 | Utton et al. | |
| 7,967,256 | B2 | 6/2011 | Wong | |
| 2004/0031593 | A1* | 2/2004 | Ernst | F28D 15/06 165/104.21 |
| 2008/0115911 | A1 | 5/2008 | Duesterhoeft | |
| 2015/0082810 | A1 | 3/2015 | Iizuka et al. | |

* cited by examiner

HEAT PIPE HEAT FLUX RECTIFIER

TECHNICAL FIELD

Embodiments described herein generally relate to a heat flux rectifier and, more specifically, to embodiments related to a heat pipe that provides unidirectional heat flux.

BACKGROUND

Many devices, such as electronic devices perform more optimally with a quick warm-up when started cold, but continue to operate more optimally the operation temperatures is within a predetermined range. These components include battery pack, engine, fuel cell stack, catalyst converter, to name a few. As a consequence, these types of devices often benefit from use of a device that may allow heat to flow in only one direction. As an example, some of these devices benefit from heat only being expelled from the device, while others may benefit from heat being absorbed by the device. Thus, a need exists in the industry.

SUMMARY

Embodiments for a heat pipe heat flux rectifier are provided. One embodiment includes a first curved diode heat pipe that includes an adiabatic section that includes a curved portion, an evaporator section that is coupled to the adiabatic section, and a condenser section that is coupled to the adiabatic section. In some embodiments, the first curved diode heat pipe includes a non-condensable gas reservoir that is coupled to the condenser section for storing non-condensable gas, where the first curved diode heat pipe stores a fluid and a wicking material. In some embodiments, the first curved diode heat pipe operates as a thermal conductor when heat is applied to the evaporator section and as a thermal insulator when heat is applied to the condenser section.

In another embodiment, a first curved heat pipe includes an adiabatic section that includes a curved portion that defines a curve, an evaporator section that is coupled to the adiabatic section, a condenser section that is coupled to the adiabatic section, and a non-condensable gas reservoir that is coupled to the condenser section for storing non-condensable gas. In some embodiments, the first curved diode heat pipe stores a fluid and a wicking material. Similarly, some embodiments may be configured with the first curved diode heat pipe operating as a thermal conductor when heat is applied to the evaporator section.

In yet another embodiment, a heat pipe heat flux rectifier includes a first conductor layer and a first curved diode heat pipe. The curved diode heat pipe may include an adiabatic section that includes a curved portion, an evaporator section that is coupled to the adiabatic section and disposed in the first conductor layer, a condenser section that is coupled to the adiabatic section, and a non-condensable gas reservoir that is coupled to the condenser section for storing non-condensable gas. Additionally, the heat pipe heat flux rectifier may include a second curved diode heat pipe disposed in a substantially parallel configuration with the first curved diode heat pipe, where at least a portion of the second curved diode heat pipe is disposed within the first conductor layer. In some embodiments, the heat pipe heat flux rectifier operates as a thermal insulator when heat is applied to the first conductor layer.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Embodiments disclosed herein include a heat pipe heat rectifier. Some embodiments are directed to a heat flux rectifier that includes a bended diode heat pipe. Accordingly, embodiments of the present disclosure apply a vapor trap from a diode heat pipe to develop a plane heat flux rectifier with thin profile. The heat flux rectifier may be configured to insulate heat at "low" temperature. In some embodiments, the heat flux rectifier dissipates heat at "high" temperature. Similarly, some embodiments are configured to provide a controlled boiling point. Embodiments may also provide high thermal conductivity from evaporator side to condenser side. Still some embodiments provide low thermal conductivity from condenser side to evaporator side. Embodiments providing the same will be described in more detail, below.

Figure 1:
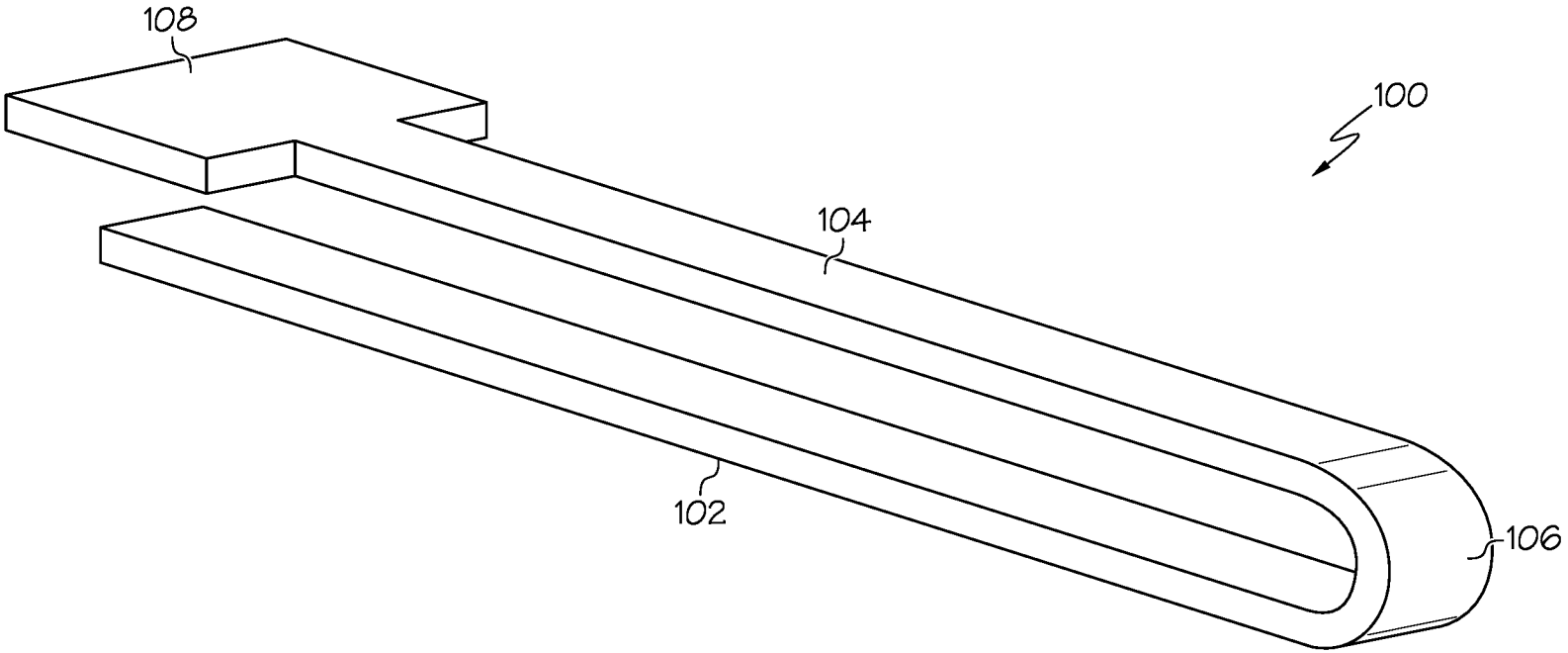
FIG. 1 depicts a curved diode heat pipe, according to embodiments described herein.

Referring now to the drawings, FIG. 1 depicts a curved diode heat pipe 100, according to embodiments described herein. The curved diode heat pipe 100 may be configured with an approximate 180 degree curve. As illustrated, the curved diode heat pipe 100 may include an evaporator section 102, a condenser section 104, adiabatic section 106, and a non-condensable gas reservoir 108. The evaporator section 102 may be constructed of a thermally conductive material, such as copper, aluminum, silicon, silicon carbide, graphite, etc. Similarly, embodiments of the condenser section 104 may be constructed of a thermally conductive material, such as copper, aluminum, silicon, silicon carbide, graphite, etc. While in some embodiments, the evaporator section 102 and the condenser section 104 are constructed with the same material, this is not a requirement. Similarly, the adiabatic section 106 may be constructed of thermal insulator and bonded to the evaporator section 102 and condenser section 104. In some embodiments, the adiabatic section 106 can be constructed of the same material (such as copper) as evaporator section 102 and the condenser section 104. Regardless, the adiabatic section 106 may include a curved portion that defines a curve, such as an approximate 180 degree curve. The thermal insulator may include quartz, plastic, ceramic, and/or the like.

Additionally, embodiments described herein may be configured to store a fluid within the curved diode heat pipe 100. Depending on the particular embodiment, the fluid may include water, coolant, and/or other material for providing the functionality described herein. Additionally, a non-condensable gas may be stored within the non-condensable gas reservoir 108. The non-condensable gas may include nitrogen, light hydrocarbons, carbon dioxide, and/or other non-condensable gaseous materials.

Within the evaporator section 102, the condenser section 104, and the adiabatic section 106 is a wicking material. The wicking material may be constructed of a high thermal-conductivity porous material for facilitating wicking of the fluid between the sections 102, 104, 106. In some embodiments, the wicking material may include a substantially uniform wick, while other embodiments may utilize different wicking materials or structures for each section. Regardless, the wicking material may include a porous media, such as monoporous wick, biporous wick, mono/biporous hybrid wick made of copper, graphite, etc., by using metal particle sintering process or by using copper inverse opal (CIO) technology, etc.

Figure 2A:
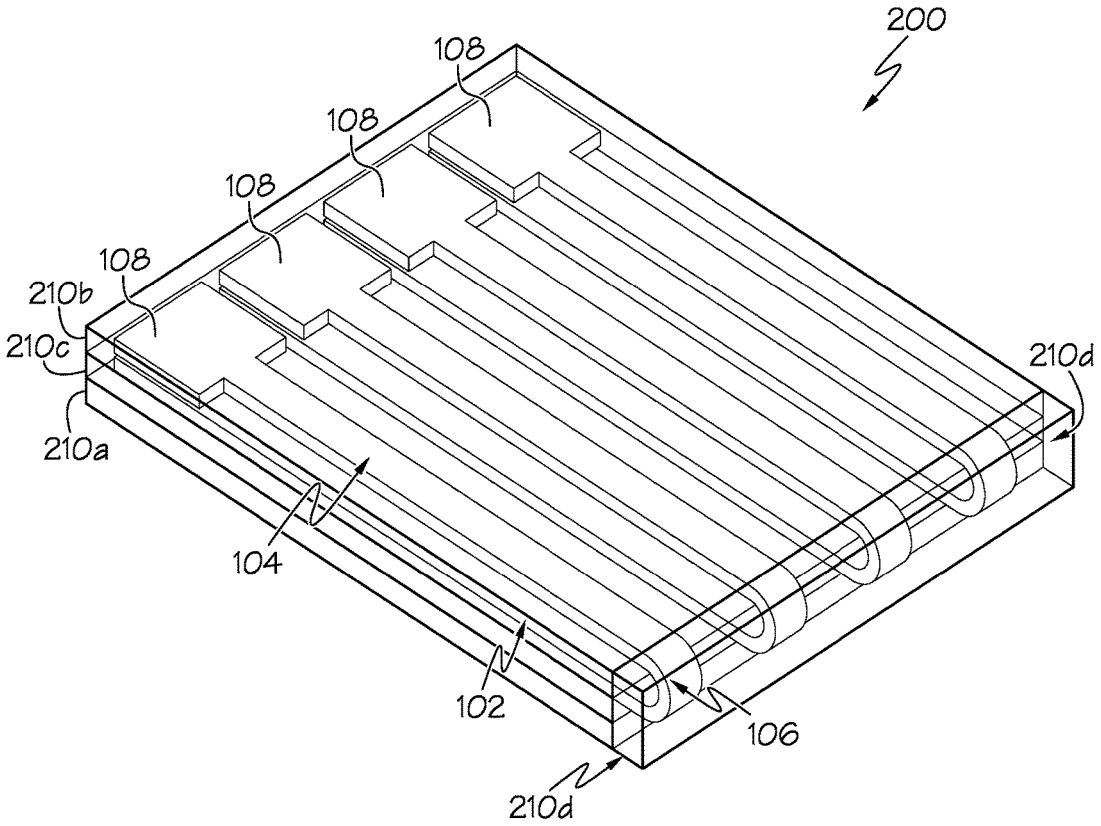
FIGS. 2A, 2B depicts a heat flux rectifier that includes a plurality of curved diode heat pipes, according to embodiments described herein.
Figure 2B:
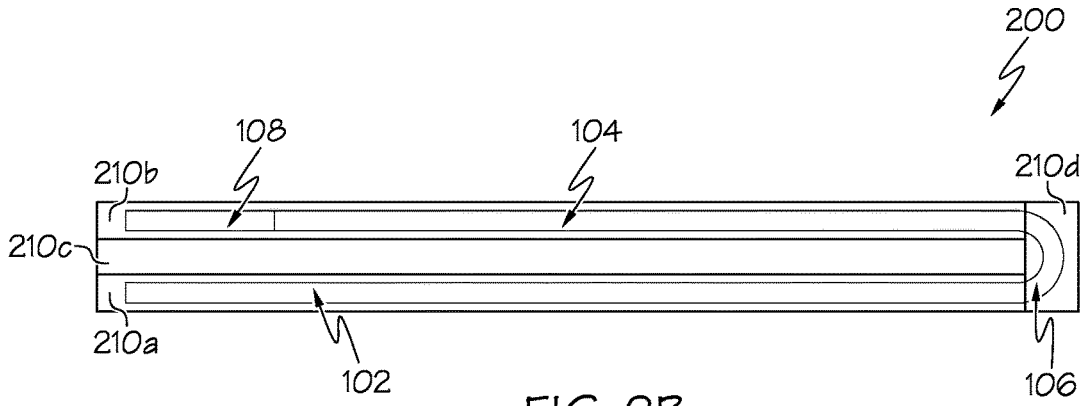

FIGS. 2A and 2B depict a heat flux rectifier 200 that includes a plurality of curved diode heat pipes 100, according to embodiments described herein. As illustrated, the plurality of curved diode heat pipes 100 (such as a first curved diode heat pipe and a second curved diode heat pipe) may be aligned in a substantially parallel configuration, with the non-condensable gas reservoirs 108 being on a similar side of the heat flux rectifier 200.

The heat flux rectifier 200 includes a plurality of different layers. A first conductor layer 210*a* and a second conductor layer 210*b* may be made of high-thermal conductivity material with the evaporator section 102 and the condenser section 104 of heat pipe being embedded therein. The high thermal conductivity material of the first conductor layer 210*a* and the second conductor layer 210*b* functions as heat spreader. A first insulator layer 210*c* is disposed between the first conductor layer 210*a* and the second conductor layer 210*b* and may be constructed of a thermal insulator to cut off the heat flow path between the first conductor layer 210*a* and the second conductor layer 210*b*. The first insulator layer 210*c* can be made of low thermal conductivity material or vacuumed chamber.

The first insulator layer 210*c* may be configured to ensure that most of the heat transfer between the first conductor layer 210*a* and the second conductor layer 210*b* is through the curved diode heat pipe 100. The adiabatic section 106 of the curved diode heat pipe 100 may be embedded in a second insulator layer 210*d*, which may be constructed of a low thermal conductivity material. The adiabatic section 106 may include an exterior material and a wicking material. The wicking structure of the adiabatic section 106 may be constructed of any material with low thermal conductivity that bonds to the condenser section 104 and evaporator section 102, which may both be constructed of materials with high thermal conductivity (e.g. copper, aluminum, silicon, silicon carbide, graphite, etc.). In some embodiments, the wicking structure of the adiabatic section 106 can be made of the same material as the wicking structures of the evaporator section 102 and/or the condenser section 104.

Figure 3A:
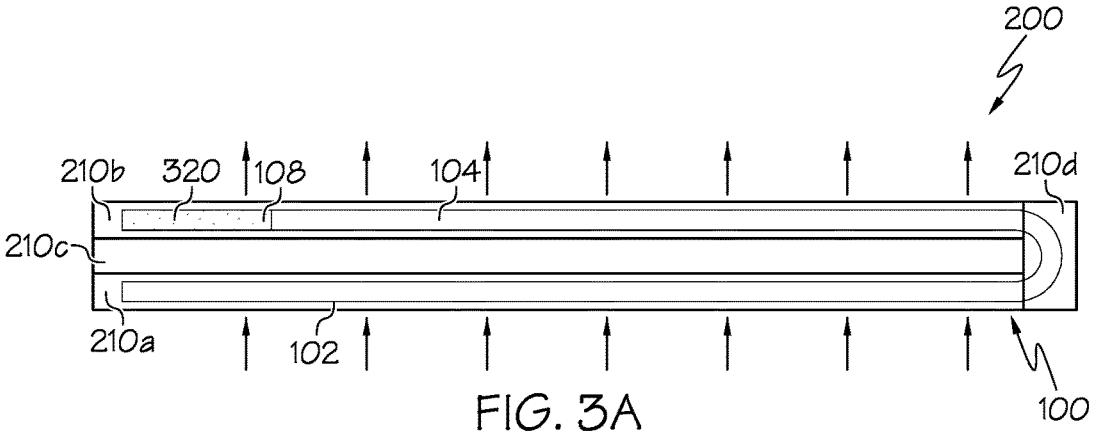
FIG. 3A depicts a forward mode of a head flux rectifier, which operates as a heat conductor, according to embodiments described herein.

FIG. 3A depicts a forward mode of a heat flux rectifier 200, which operates as a heat conductor, according to embodiments described herein. As illustrated, when the evaporator section 102 is heated and the top layer is cooled not heated (forward mode), the liquid within the wicking material of the evaporator section 102 starts evaporating. The vapor carries heat away from the evaporator section 102, travels through the adiabatic section 106, and condenses at the condenser section 104. The non-condensable gas within the curved diode heat pipe 100 is driven into the non-condensable gas reservoir 108, which does not affect the heat transfer. The condensate returns back to the evaporator section 102 through the wicking material by capillary force, completing the cycle with high heat transfer capability.

Figure 3B:
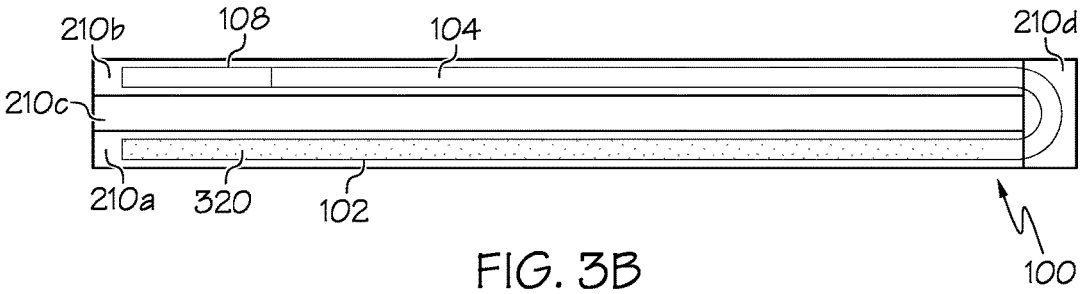
FIG. 3B depicts a reverse mode of a heat flux rectifier, which operates as a heat insulator, according to embodiments described herein.

FIG. 3B depicts a reverse mode of a heat flux rectifier 200, which operates as a heat insulator, according to embodiments described herein. As illustrated, when the top surface of the condenser section 104 is heated and bottom surface of the evaporator section 102 is cooled or otherwise not heated (reverse mode), the non-condensable gas may be dragged along with the flowing vapor. Eventually, the non-condensable gas completely blocks the evaporator section 102, greatly increasing the thermal resistivity of the curved diode heat pipe 100. Therefore, a thermal rectification in forward and reserve operation modes can be expected.

Since the heat flux rectifier 200 has a thin profile, it can be used as a cover of a device, only allowing heat to be dissipated from the device but shielding the external heat. Additionally, some embodiments may be coupled to a device to become a heat absorber, only allowing heat to enter, but not easy to be released. When the heat flux rectifier 200 is operating in forward mode, if the liquid in the wicking material of the evaporator section 102 is heated to the liquid boiling point, heat may be transferred from the evaporator section 102 to the condenser section 104. When the evaporator temperature is lower than the boiling point, heat is transferred through pure conduction. The evaporating temperature of the liquid can be tuned by controlling the partial vapor pressure (amount of non-condensable gas) inside the curved diode heat pipe 100 during the manufacturing. Additionally, different liquids can be used for different applications, as described above.

By tuning the boiling point of the liquid within the curved diode heat pipe 100 during manufacturing, a switch point may be set up. For example, if the pressure is tuned such that the liquid boils at 35 C, then in the forward mode, when the evaporator temperature is lower than 35 C, the curved diode heat pipe 100 still functions as a thermal insulator. When the curved diode heat pipe 100 is operating in forward mode and the evaporator temperature is higher than 35 C, the curved diode heat pipe 100 operates as a thermal conductor. This thermal switching function may be utilized for cold starting some systems. For example, if a battery pack is covered with the heat flux rectifier 200, then thermal energy can be stored within the battery pack overnight, so that the battery pack is still warm when the system is started the next morning. This thermal switch function may also be utilized for other systems (such as an engine) but the boiling point might be tuned to a higher or lower temperature, depending on the embodiment.

Figure 4:
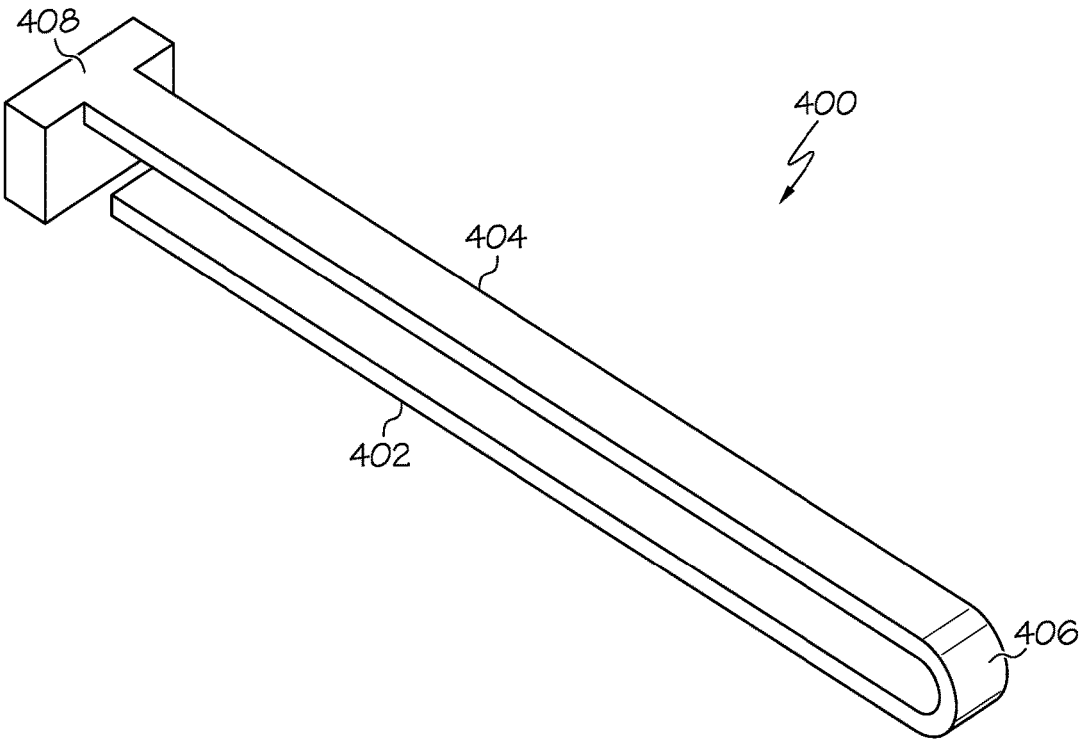
FIG. 4 depicts a curved diode heat pipe that utilizes a non-condensable gas reservoir that is placed adjacent a condenser section, according to embodiments described herein.

FIG. 4 depicts a curved diode heat pipe 400 that utilizes a perpendicular non-condensable gas reservoir 408 that is placed adjacent a condenser section 404, according to embodiments described herein. As illustrated, the curved diode heat pipe 400 includes an evaporator section 402, a condenser section 404, an adiabatic section 406, and a perpendicular non-condensable gas reservoir 408. The curved diode heat pipe 400 may include a fluid, such as water, refrigerant, and/or other fluid. Additionally, a wicking material may be included inside the curved diode heat pipe 400 for communicating condensate, and/or evaporated fluid, as described above.

While the embodiments of FIGS. 1, 2A, 2B, 3A, and 3B depict the curved diode heat pipe 100 with the non-condensable gas reservoir 108 may be relatively flat and substantially coplanar with the condenser section 104, the embodiment of FIG. 4 (as well as FIGS. 5A and 5B) depicts that the perpendicular non-condensable gas reservoir 408 is disposed substantially perpendicular to the evaporator section 402 and/or the condenser section 404. Additionally, the perpendicular non-condensable gas reservoir 408 may be coupled to and in fluid communication with the condenser section 404, with a gap (or other material) separating the perpendicular non-condensable gas reservoir 408 and the evaporator section 402. Accordingly, the embodiments of FIG. 4 may utilize a larger area of the condenser section 404 for dissipating heat.

Figure 5A:
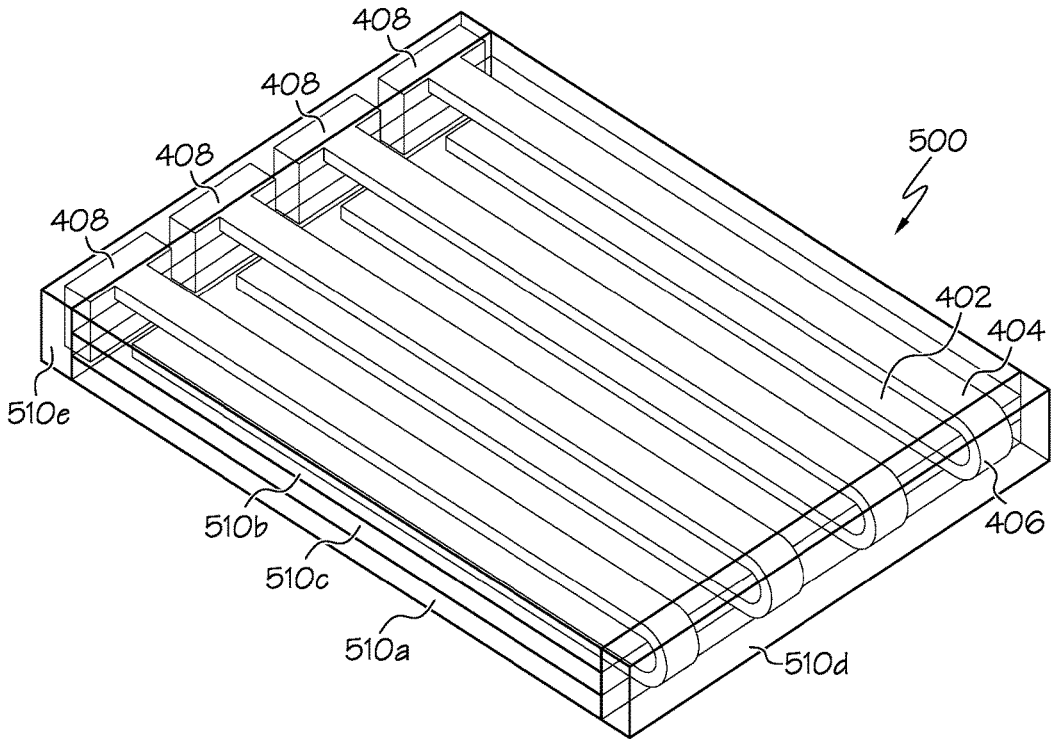
FIG. 5A depicts a heat flux rectifier that utilizes a plurality of perpendicular non-condensable gas reservoirs, according to embodiments described herein.

FIG. 5A depicts a heat flux rectifier 500 that utilizes a plurality of perpendicular non-condensable gas reservoirs 408, according to embodiments described herein. As illustrated, the heat flux rectifier 500 may include a plurality of curved diode heat pipes 400. The plurality of curved diode heat pipes 400 may be aligned in a parallel configuration. As with the heat flux rectifier 200 from FIG. 2A, the heat flux rectifier 500 may be configured with the plurality of curved diode heat pipes 400 being arranged with the perpendicular non-condensable gas reservoirs 408 on a similar side of the heat flux rectifier 500. Some embodiments may arrange the curved diode heat pipes 400 such that the perpendicular non-condensable gas reservoirs 408 are not disposed on a similar side of the heat flux rectifier 500.

Similar to the heat flux rectifier 200 of FIGS. 2A and 2B, the heat flux rectifier 500 includes a first conductor layer 510*a* that surrounds the evaporator section 402. A second conductor layer 510*b* may surround the condenser section 404. A first insulator layer 510*c* may be disposed between the first conductor layer 510*a* and the second conductor layer 510*b*. Also provided is a second insulator layer 510*d*, which covers the adiabatic section 406 for each of the curved diode heat pipes 400. A third insulator layer 510*e* may surround at least a portion of the perpendicular non-condensable gas reservoir 408. As described above, the plurality of layers 510*a*, 510*b*, 510*c*, 510*d*, and 510*e* are configured to direct heat through the curved diode heat pipes 400.

Figure 5B:
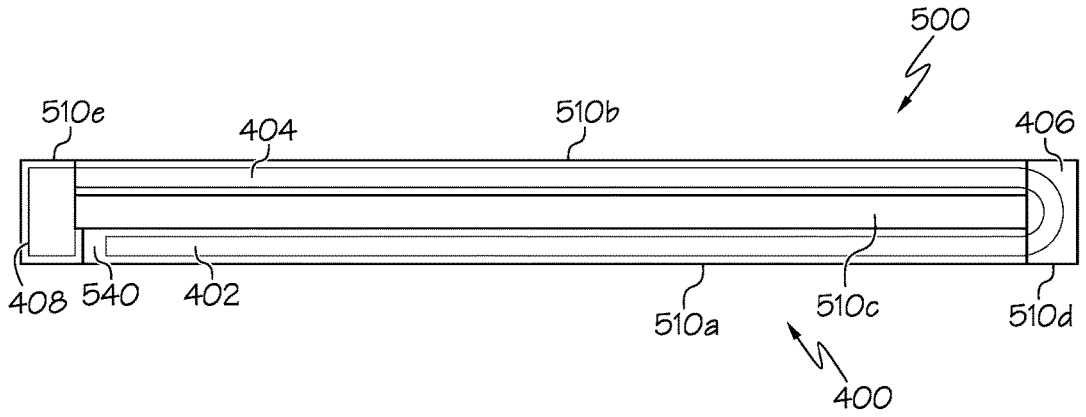
FIG. 5B depicts a side view of a heat flux rectifier utilizing a plurality of perpendicular non-condensable gas reservoirs, according to embodiments described herein.

FIG. 5B depicts a side view of a heat flux rectifier 500 utilizing a plurality of perpendicular non-condensable gas reservoirs 408, according to embodiments described herein. As illustrated, the evaporator section 402 may be coupled to the adiabatic section 406, as well as to a thermal conductor 540, which is also coupled to the perpendicular non-condensable gas reservoir 408. The thermal conductor 540 may include copper, aluminum, silicon, silicon carbide, graphite, etc. Also coupled to the perpendicular non-condensable gas reservoir 408 and the adiabatic section 406 is the condenser section 404.

In operation, the heat flux rectifier 500 may react similarly as the heat flux rectifier 200 from FIGS. 2A and 2B. Specifically, when heat is applied to the evaporator section 402, the heat may cause the fluid in the evaporator section 402 to evaporate and travel to the adiabatic section 406 and to the condenser section 404. The heat may then escape out of the condenser section 404 as the fluid condenses and returns to the evaporator section 402 via the wicking material. As also described above, the non-condensable gas in this forward mode of operation may remain in the perpendicular non-condensable gas reservoir 408.

In the reverse mode, heat is applied to the condenser section 404. The non-condensable gas may leave the perpendicular non-condensable gas reservoir 408 into the condenser section 404. The non-condensable gas may thus act as a thermal insulator, thereby reducing the transfer of heat out of the heat flux rectifier 500.

As illustrated above, various embodiments heat pipe heat flux rectifier are disclosed. These embodiments may be configured to operate as a thermal diode and/or thermal switch. The thermal diode operates to transfer heat in one direction, but to act as a thermal insulator when heat is applied to anther side of the heat pipe heat flux rectifier.

While particular embodiments and aspects of the present disclosure have been illustrated and described herein, various other changes and modifications can be made without departing from the spirit and scope of the disclosure. Moreover, although various aspects have been described herein, such aspects need not be utilized in combination. Accordingly, it is therefore intended that the appended claims cover all such changes and modifications that are within the scope of the embodiments shown and described herein. It should also be understood that these embodiments are merely exemplary and are not intended to limit the scope of this disclosure.

What is claimed is:

1. A heat pipe heat flux rectifier comprising:

a first curved diode heat pipe comprising:

an adiabatic section that includes a curved portion;

an evaporator section that is coupled to the adiabatic section;

a condenser section that is coupled to the adiabatic section; and a non-condensable gas reservoir that is coupled to the condenser section for storing non-condensable gas, wherein the first curved diode heat pipe stores a fluid and a wicking material, wherein the first curved diode heat pipe operates as a thermal conductor when heat is applied to the evaporator section, and wherein the first curved diode heat pipe operates as a thermal insulator when heat is applied to the condenser section.

2. The heat pipe heat flux rectifier of claim 1, further comprising:

a first conductor layer that surrounds the evaporator section;

a second conductor layer that surrounds the condenser section;

a first insulator layer disposed between the evaporator section and the condenser section; and a second insulator layer that surrounds the adiabatic section.

3. The heat pipe heat flux rectifier of claim 2, wherein the first conductor layer and the second conductor layer are constructed using at least one of the following: copper, aluminum, silicon, silicon carbide, and graphite, and wherein the first insulator layer and the second insulator layer are constructed using at least one of the following: quartz, plastic, and ceramic.

4. The heat pipe heat flux rectifier of claim 1, wherein the non-condensable gas reservoir is disposed substantially coplanar with the condenser section.

5. The heat pipe heat flux rectifier of claim 1, wherein the non-condensable gas reservoir is disposed substantially perpendicular to the condenser section, and wherein the evaporator section is coupled to the non-condensable gas reservoir via a thermally conductive material.

6. The heat pipe heat flux rectifier of claim 1, wherein the wicking material is disposed within the first curved diode heat pipe.

7. The heat pipe heat flux rectifier of claim 6, wherein when heat is applied to the evaporator section, the fluid captures the heat, evaporates, is communicated to the condenser section, and is released through the condenser section, thereby condensing the fluid.

8. The heat pipe heat flux rectifier of claim 1, further comprising a second curved diode heat pipe.

9. A first curved diode heat pipe comprising:

an adiabatic section that includes a curved portion that defines a curve;

an evaporator section that is coupled to the adiabatic section;

a condenser section that is coupled to the adiabatic section; and a non-condensable gas reservoir that is coupled to the condenser section for storing non-condensable gas, wherein the first curved diode heat pipe stores a fluid and a wicking material, wherein the first curved diode heat pipe operates as a thermal conductor when heat is applied to the evaporator section; and wherein the first curved diode heat pipe operates as a thermal insulator when heat is applied to the condenser section.

10. The first curved diode heat pipe of claim 9, wherein the non-condensable gas reservoir is disposed substantially coplanar with the condenser section.

11. The first curved diode heat pipe of claim 9, wherein the non-condensable gas reservoir is disposed substantially perpendicular to the condenser section, and wherein the evaporator section is coupled to the non-condensable gas reservoir via a thermally conductive material.

12. The first curved diode heat pipe of claim 9, further comprising the wicking material disposed within the first curved diode heat pipe.

13. The first curved diode heat pipe of claim 9, wherein when heat is applied to the evaporator section, the fluid captures the heat, evaporates, is communicated to the condenser section, and is released through the condenser section, thereby condensing the fluid.

14. The first curved diode heat pipe of claim 9, wherein an insulator is disposed between the evaporator section and the condenser section.

15. A heat pipe heat flux rectifier comprising:

a first conductor layer; and a first curved diode heat pipe comprising:

an adiabatic section that includes a curved portion;

an evaporator section that is coupled to the adiabatic section and disposed in the first conductor layer;

a condenser section that is coupled to the adiabatic section; and a non-condensable gas reservoir that is coupled to the condenser section for storing non-condensable gas; and a second curved diode heat pipe disposed in a substantially parallel configuration with the first curved diode heat pipe, wherein at least a portion of the second curved diode heat pipe is disposed within the first conductor layer, and wherein the heat pipe heat flux rectifier operates as a thermal insulator when heat is applied to the first conductor layer.

16. The heat pipe heat flux rectifier of claim 15, further comprising:

a second conductor layer, wherein the second conductor layer is coupled to the condenser section and at least a portion of the second curved diode heat pipe;

a first insulator layer disposed between the evaporator section and the condenser section; and a second insulator layer that surrounds the adiabatic section.

17. The heat pipe heat flux rectifier of claim 15, wherein the non-condensable gas reservoir is disposed substantially coplanar with the condenser section.

18. The heat pipe heat flux rectifier of claim 15, wherein the non-condensable gas reservoir is disposed substantially perpendicular to the condenser section, and wherein the evaporator section is coupled to the non-condensable gas reservoir is coupled to the evaporator section via a thermally conductive material.

19. The heat pipe heat flux rectifier of claim 18, further comprising a third insulator layer that surrounds the non-condensable gas reservoir.

20. The heat pipe heat flux rectifier of claim 18, wherein when heat is applied to the evaporator section, a fluid in the heat pipe heat flux rectifier captures the heat, evaporates, is communicated to the condenser section, and is released through the condenser section, thereby condensing the fluid.

* * * * *